United States Patent [19]

Hyttinen

[11] Patent Number: 4,527,926

[45] Date of Patent: Jul. 9, 1985

[54] METHOD FOR BUILDING A PROTECTIVE WALL WHEN CONSTRUCTING AN UNDERWATER BASE

[76] Inventor: Seppo J. Hyttinen, Louhimo, 50100 Mikkeli 10, Finland

[21] Appl. No.: 402,549

[22] Filed: Jul. 28, 1982

Related U.S. Application Data

[63] Continuation-in-part of Ser. No. 179,542, Aug. 19, 1930, abandoned, which is a continuation-in-part of Ser. No. 931,993, Aug. 7, 1978, abandoned, which is a continuation of Ser. No. 803,999, Jun. 6, 1977, abandoned.

[51] Int. Cl.[3] ..... E02D 19/04

[52] U.S. Cl. ..... 405/14; 405/222

[58] Field of Search ..... 405/11, 13, 14, 195, 405/203, 211, 222, 225, 229, 231; 249/10, 11; 264/31, 32

[56] References Cited

U.S. PATENT DOCUMENTS

| | | | |
|---|---|---|---|
| 457,438 | 8/1891 | Hunt | 405/203 |
| 1,057,859 | 4/1913 | Libbey | 405/14 |
| 1,394,571 | 10/1921 | Moran | 405/203 X |
| 1,418,879 | 6/1922 | Rice | 405/13 |
| 1,584,203 | 5/1926 | Upson | 405/222 |
| 2,043,452 | 6/1936 | Strauss | 405/222 |
| 2,317,016 | 4/1943 | Allen | 405/222 |
| 2,669,000 | 2/1954 | Seemann | 249/10 |
| 3,097,493 | 7/1963 | Blankevoort | 405/134 |
| 3,871,181 | 3/1975 | Delong | 405/11 |
| 4,202,647 | 5/1980 | Lamy | 405/14 X |

*Primary Examiner*—David H. Corbin

*Attorney, Agent, or Firm*—Woodling, Krost, Rust & Hochberg

[57] ABSTRACT

An underwater construction which includes a concrete base slab and a protective wall. The lower end of the protective wall remains somewhat in the concrete cast of the base slab. The protective wall is formed by vertically extending elements. Water may be pumped from the space within the protective wall to produce a dry space.

10 Claims, 3 Drawing Figures

METHOD FOR BUILDING A PROTECTIVE WALL WHEN CONSTRUCTING AN UNDERWATER BASE

This patent application is a continuation-in-part of U.S. patent application, Ser. No. 179,542 filed Aug. 19, 1980 and entitled Method For Building A Protective Wall when Constructing An Underwater Base, now abandoned, which application is a continuation-in-part of U.S. patent application, Ser. No. 931,993 filed Aug. 7, 1978 and entitled Method For Building A Protective Wall When Constructing An Underwater Base, now abandoned, which in turn was a continuation of U.S. patent application, Ser. No. 803,999 filed June 6, 1977, entitled Method For Building A Protective Wall When Constructing An Underwater Base, now abandoned.

The present invention is concerned with a protective wall that stands the pressure of water and that is required in order to produce an underwater construction as dry work within the space limited by said protective wall. In the present specification, by underwater base is meant the underwater portion of a bridge, wharf, or any other construction to be built in water that is not concreted by means of an underwater method (so-called Contractor concreting).

Protective walls are previously known which are made of wooden or steel planks with grooves and tongues and extending from the bottom of the water up to above the water level. In such a case, with wooden wall with matched joints, the section of the wall placed at the base slab has been used as the mould of the base slab, and the section above the base slab as the protective wall for the dry work. In steel walls with matched joints, corresponding, the section at the base slab has, wholly or partly, constituted mould face, whereby, in the latter case, part of the wall has been lined with a wooden mould. The section above has been a protective wall in the way corresponding to the wooden wall with matched joints. In both the protective walls are normally of a single substantially uniform diameter throughout their height.

The above methods involve the drawback of high expenses, which result from expensive preliminary and finishing work (working bridges), from large quantity and losses of material, as well as from increased overhead expenses caused by the prolonged construction period.

The method in accordance with the invention is characterized in that the protective wall does not extend substantially outside the outer periment of the formwork of the base slab and the protective wall vertically extends from somewhat below the top of the base slab up to above the water level, said base slab being poured by underwater concreting.

The most important advantages are obtained from the use of the methods concerned when constructing a wall of steel with matched joints and with an increasing depth of water. However, it is also possible to obtain savings when using a wooden wall with matched joints. The most important advantages are those listed below:

1. The material consumption is reduced. In the case of a steel wall, the section at the base slab is omitted, and in the case of a wooden wall with matched joints, each component wall can be dimensioned in the way best suitable for the construction work.
2. The base slab and protective wall are normally of differing diameters; the after-poured underwater concrete forms an excellent seal between the top of the base slab and the bottom of the protective wall too.
3. It is easy to disassemble the protective wall, for which reason its units are not damaged and can, consequently, be used several times.
4. The wall units can be placed in position and disassembled by means of considerably smaller machines than when using the former methods. For example, if the depth from the water level to the bottom is 10 meters and that to the top face of the base slab is 5 meters and if planks with tongues and grooves of a length of 12 and 7 meters are available, when lifting, the support point with the known method must be at a height of at least 9 meters and with the method now described at a height of at least 6 meters from the water surface. In this way, the use of large cranes as well as working bridges for such cranes are avoided. Often it is possible to install the planks with tongues and grooves by means of a small excavator placed on pontoons.
5. The transport costs for the wall units are reduced.
6. If the construction object or the working objects comprise several underwater constructions, the following procedure might be economical: A raft is constructed that includes anchoring means, e.g. legs supportable against the bottom, and that is provided with equipment suitable for underwater concreting. The mould of the base slab is placed on the bottom, the raft is brought above the mould, the casting of the base slab is performed. The raft is then replaced by a complete protective wall construction supported by pontoons, which construction is lowered onto the base slab and supported at predetermined position, by means of the mould of the base slab or otherwise. If the positioning of the protective wall takes place before the setting up of the underwater concreting of the base slab, the bottom of the protective wall can be extended into the underwater concrete to form a seal therebetween. If the positioning of the protective wall takes place after the setting up of the underwater concreting of the base slab, or if desired, a second underwater concreting can be made to tie the bottom of the protective wall with the top of the base slab, forming a seal therebetween. After the protective wall is sealed to base slab, the water is pumped out of the confines of the protective wall and dry work construction begun.

The attached drawing illustrates an embodiment of the invention that illustrates the use of the method in bridge construction work.

Figure 1:
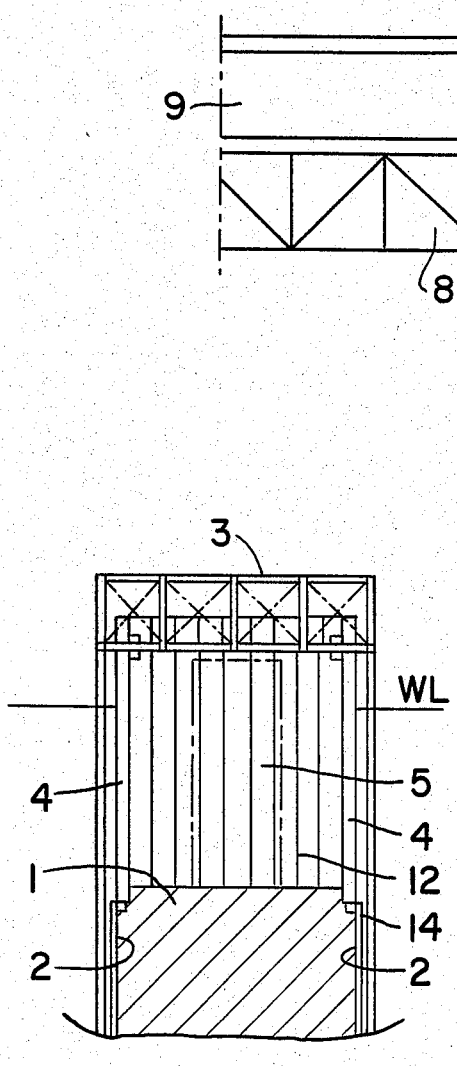
FIG. 1 shows a vertical section of a bridge pier in the longitudinal direction of the bridge.

Reference numeral 1 denotes the base slab, 2 the mould of the base slab, 3 working scaffold and support scaffold for the protective wall, 4 the protective wall, 5 the portion of the bridge pier to be concreted in the dry space limited by the protective wall, 6 support columns of the scaffolds of the deck construction, 7 the section of the bridge pier placed above the water level, 8 the scaffolds of the deck construction, 9 the deck construction of the bridge, 10 supporting of the protective walls on the concreted section 5 of the bridge pier, 11 the connection between the protective wall and the support columns, 12 the vertical joints of the protective wall and 13 the beam frame connecting the mould wall to the protective wall.

In the solution in accordance with FIG. 1, the protective wall 4 is at its lower end supported on the mould 2 of the base slab, with or without the support member 14. The bottom edge of the protective wall 4 extends substantially to the plane defined by the top peripheral edge of the formwork mould wall 2. The bottom edge of the protective wall 4 is within the top peripheral edge of the formwork mould. The upper end of the protective wall 4 is supported and positioned horizontally by the working scaffold 3. The wall can also be built so that it is suspended on a scaffold placed above. Thereby the protective wall can be made smaller, but, on the other hand, the expenses are increased, because a stronger scaffold 3 is required.

Figure 2:
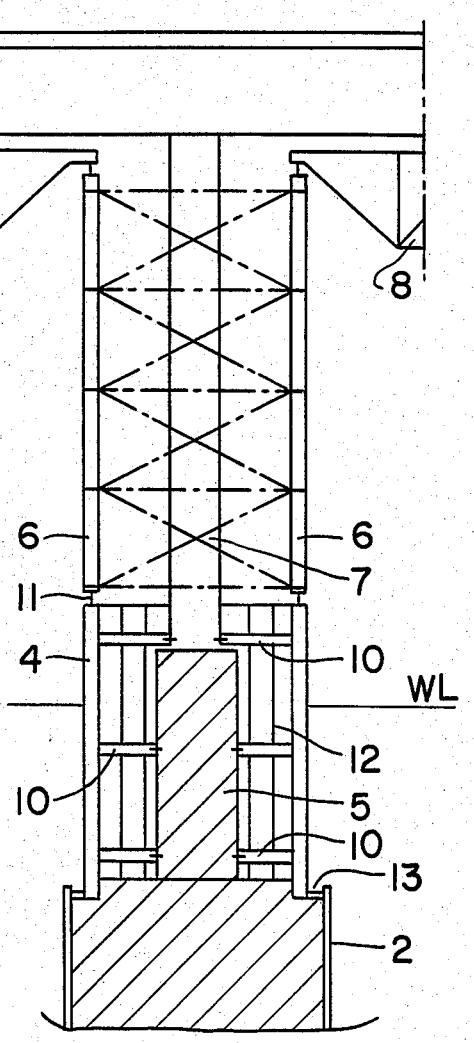
FIG. 2 shows the same section as supplemented by means of the steel scaffold construction placed above.

In the solution in accordance with FIG. 2, the construction of the intermediate support 7 is simplified. Since the width of the wall-shaped portion 5 of a bridge pier in the longitudinal direction of the bridge is small, it has been necessary to perform the work, when using steel scaffolds with the scaffold columns supported on said construction 5, so that first a framework supporting the mould of the pier 7 has been made, then the mould, the casting has been performed, the moulds disassembled together with the concreting scaffolds, and only then has it been possible to place the support columns of the scaffold supports in position. If the columns are supported on the steel wall with tongues and grooves, they can be used as concreting scaffolds and for supporting the pier mould, in which case time and expenses are saved. Other advantages could also be obtained by means of the method concerned. The span of the steel supports would become shorter and, since the length of the base slab 1 in the transverse direction of the bridge is larger than the corresponding dimension of the pier 5 placed on same, the support face of the profile steel beam placed underneath the scaffold columns would become longer. Thus, it would be possible to use beams of a profile smaller than what was possible in previous methods.

In the embodiment in accordance with FIG. 2, in which the scaffold loads are transferred over the protective wall to the base slab and further to the base ground, when planning and performing the work, consideration must, however, be given to the unusually eccentric loads straining the construction and the ground. The protective wall is supported and positioned horizontally by beam frame 13 to the formwork mould wall 2 during underwater concreting.

In the embodiments of both FIGS. 1 and 2 the protective walls 4 are positioned in respect to the mould walls 2 before the pouring of the base slabs 1 by underwater concreting. The outer diameter of the protective walls 4 are equal to or less than the outer diameter of the mould walls 2. The bottom of the protective walls 4 are positioned to extend somewhat into the underwater concreting of the base slabs 1 to form a substantially watertight seal therebetween.

Figure 3:
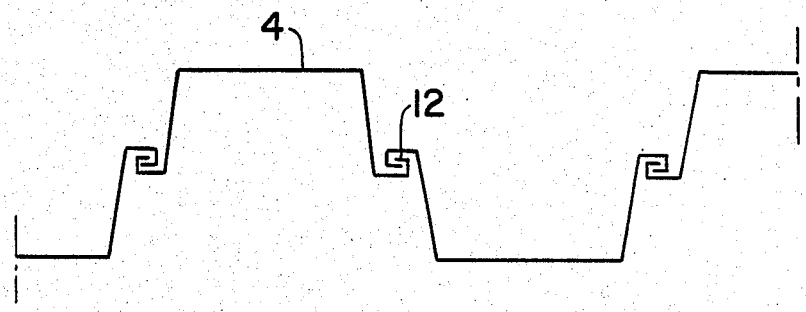
FIG. 3 shows an enlarged cross-sectional view of the vertical joints of the protective wall.

A type of vertical joint 12 that can be used to interconnect the sections of the protective wall 4 is shown in FIG. 3. Tongue and groove joints, interlocking offset joints and other types of cassion joints could also be used.

The thickness of the base slab of a bridge pier is, as a rule, determined by the depth of the water, i.e. the thickness of the base slab must be at least large enough that its weight corresponds to the pressure of water acting upon the bottom of the slab. When this method is used, the thickness of the base slab can be reduced to some extent. This may be necessary at least when the height of the top face of the base slab is affected by the depth of the passage in the bridge opening and when the ground in the bottom is hard to remove.

What is claimed is:

1. A method of building a protective wall when constructing an underwater concrete base consisting of positioning a formwork having a width dimension at a prepared location, said formwork having a top peripheral edge, positioning an annular continuous protective wall having a width dimension not exceeding the width dimension of said formwork above said formwork with the bottom edge of said protective wall extending substantially through the plane defined by the top peripheral edge of said formwork, said protective wall being formed by in-line vertically extending units joined by vertical joints, and underwater concreting a base slab in said formwork, said base slab intersecting said bottom edge of said protective wall to seal the bottom of said protective wall.

2. The method of claim 1 characterized in that said protective wall is held in position in respect to said formwork by a scaffold.

3. An underwater construction including in combination a base slab of concrete having a lower end portion engaging the ground and having an upper end portion, wall means defining the outer perimeter of said base slab, a protective wall having a lower end portion supported in the region of the periphery of said upper end portion, said protective wall being formed by in-line vertically extending joined by vertical joints and sealed to the base slab at its lower end by underwater concrete, said protective wall being annularly continuous and defining a space from which water may be pumped to produce a dry space for underwater construction, and said protective wall having a perimeter of such size that it does not extend outside the region of said perimeter of said base slab.

4. An underwater construction as claimed in claim 3, wherein a concrete support pier is located within said protective wall, said support pier having a lower end portion engaging said upper end portion of said base slab and an upper end portion extending to a height at least near the upper end portion of said protective wall.

5. A method of building a protective wall when constructing an underwater concrete base comprised of positioning a formwork at a prepared location, positioning an annular continuous wall in the range of said location so that it is substantially inside the outer periment of the formwork, said protective wall being formed by in-line vertically extending elements joined by vertical joints and extending to above the water level, and underwater concreting the top of the base slab in said formwork to above the level of the bottom of said protective wall to seal the bottom of the protective wall by the base slab.

6. The method of claim 5, wherein the base slab is underwater concreted and at the same time the bottom edge of the protective wall is underwater concreted to the base slab.

7. The method of claim 5, wherein afterpoured underwater concrete forms a seal after underwater concreting the base slab and positioning the protective wall.

8. The method of claim 5, wherein the base slab is underwater concreted after positioning the protective wall.

9. The method of claim 5, wherein underwater concreting at least to form a seal between the top of the base slab and the bottom of the protective wall is done immediately before positioning the protective wall.

10. A method of building a protective wall when constructing an underwater concrete base comprising positioning a formwork having a width dimension at a prepared location, said formwork having a top peripheral edge, positioning an annular continuous protective wall having a width dimension not exceeding the width dimension of said formwork above the ground above said formwork with the bottom edge of said protective wall extending substantially through the plane defined by the top peripheral edge of said formwork, said protective wall being separate from said formwork, said protective wall being formed by in-line vertically extending units joined by vertical joints, said joints extending substantially top to bottom of said protective wall, and underwater concreting the top of a base slab in said formwork, said top of said base slab intersecting said bottom edge of said protective wall to seal the bottom of said protective wall.

* * * * *